United States Patent [19]

Peters et al.

[11] Patent Number: 4,500,004

[45] Date of Patent: Feb. 19, 1985

[54] TRANSPORT CARRIAGE

[75] Inventors: Penn A. Peters; Cleveland J. Biller; David D. Johnson, all of Morgantown, W. Va.

[73] Assignee: The United States of America as represented by the Secretary of Agriculture, Washington, D.C.

[21] Appl. No.: 530,829

[22] Filed: Sep. 9, 1983

[51] Int. Cl.[3] ..... B66C 17/06

[52] U.S. Cl. ..... 212/80; 212/87; 212/89; 212/122

[58] Field of Search ..... 212/76, 77, 80, 82, 212/83, 87, 89, 95, 96, 105, 110, 116, 122

[56] References Cited

U.S. PATENT DOCUMENTS

| | | | |
|---|---|---|---|
| 377,063 | 1/1888 | Chambard . | |
| 504,522 | 9/1893 | Donahue | 212/77 |
| 570,386 | 10/1896 | Dickinson | 212/89 |
| 733,190 | 7/1903 | Griesser | 212/80 |
| 784,167 | 3/1905 | Louden . | |
| 1,151,299 | 8/1915 | Shaw . | |
| 1,530,244 | 3/1925 | Dickinson | 212/89 |
| 1,569,176 | 1/1926 | Dunham . | |
| 1,756,732 | 4/1930 | Dickinson . | |
| 4,005,779 | 2/1977 | Andrews | 212/87 |
| 4,136,786 | 1/1979 | Morrow et al. . | |
| 4,262,811 | 4/1981 | Montague . | |

*Primary Examiner*—Trygve M. Blix
*Assistant Examiner*—Stephen P. Avila
*Attorney, Agent, or Firm*—M. Howard Silverstein; David G. McConnell

[57] ABSTRACT

An improved carriage for use in a skyline logging system simultaneously utilizing more than one load cable with the same carriage for connecting to and dragging separate "turns" of logs from the area in which they were felled to a landing area next to the yarder machine.

4 Claims, 3 Drawing Figures

TRANSPORT CARRIAGE

FIELD OF THE INVENTION

The invention relates to an improved transport carriage for use in skyline logging systems, and more particularly pertains to a transport carriage that accommodates more than one load line.

BACKGROUND OF THE INVENTION

Skyline logging systems are, in general, capable of handling only a single load line, that load line bearing a single "turn" of logs. Some systems, as for example that disclosed in U.S. Pat. No. 4,136,786 to Morrow, et al., have suggested that a plurality of choker or load lines bearing a "turn" of logs may be utilized. However, even these systems would require that the logs of all of the "turns" be picked up from the area vertically below the track cable or high line of the skyline logging system. A "turn" of logs could not be recovered from an area away from the line of the high line since this would act to twist the carriage on the high line even though it was already bearing several turns of log suspended directly from that carriage. The resulting forces would not be on a line through the track block of the carriage onto the high line but would be pivoted from a line through the track block raising the possibility of the carriage slipping off the high line and thereby rendering the system inoperable.

Since not all logging operations occur directly below a high line, it is necessary with the carriage mechanisms to either transport the logs to a point directly underneath the high line or make due with a single "turn" of logs per cycle. Therefore, there is a need for an improved transport carriage for use in a high line skyline logging system, whereby multiple "turns" of wood may be transported simultaneously while still retaining the optimum operating conditions for the carriage as it moves along the high line.

DESCRIPTION OF THE PRIOR ART

U.S. Pat. No. 377,063 to Chambard discloses a hay elevator for raising and moving a load of hay. There are two pulleys J shown in FIG. 1 which are movable relative to one another and also movable relative to the carriage B itself.

U.S. Pat. No. 784,167 to Louden discloses an elevator carrier in which there are two pulley arrangements I, which are movable relative to one another.

U.S. Pat. No. 1,151,299 to Shaw discloses a high line logging system which includes a single load line to carry a single turn of logs to the landing point on any one transport carriage.

U.S. Pat. No. 1,569,176 to Dunham discloses a skyline logging system having a single lifting (or load) block in the same plane as the track block.

U.S. Pat. No. 1,756,732 discloses a skyline logging system in which the load block is pivotable.

U.S. Pat. No. 4,136,786 to Morrow discloses a logging system and yarder therefore. FIGS. 1 and 2 disclose a carriage with means for supporting a plurality of choker cables.

U.S. Pat. No. 4,262,811 to Montague discloses a log transporting carriage assembly which includes a carriage lock and unlock mechanism with two operable positions. The first position releases a main or load line relative to the carriage while locking the carriage along the high or skyline. The second position reverses these effects. The loadline block is involved in the locking of the carriage to the main line and is not free to swivel relative thereto.

SUMMARY OF THE INVENTION

This invention provides an improved carriage for use in a skyline logging system which allows multiple "turns" of timber to be transported by a single carriage. Those "turns" of wood may be recovered from positions other than those immediately and vertically below the skyline cable of a skyline logging system.

The carriage includes a track block and a first load block where the track block is retained within a carriage frame. Means are provided for connecting the first load block to the carriage frame. A means is provided on the carriage frame that releasably clamps the carriage to a skyline or high line passing through the carriage and under the track block. An additional means is provided on the carriage frame which releasably clamps the carriage to a load line passing through the carriage frame and over the first load block. The first load block is connected to the carriage frame by a pivotable connector, as is a second load block that has been provided on the carriage.

BRIEF DESCRIPTION OF THE DRAWINGS

The best mode contemplated in carrying out this invention is illustrated and better understood by reference to the following detailed description when considered in conjunction with the accompanying drawings, in which.

DESCRIPTION OF THE PREFERRED EMBODIMENT

Figure 1:
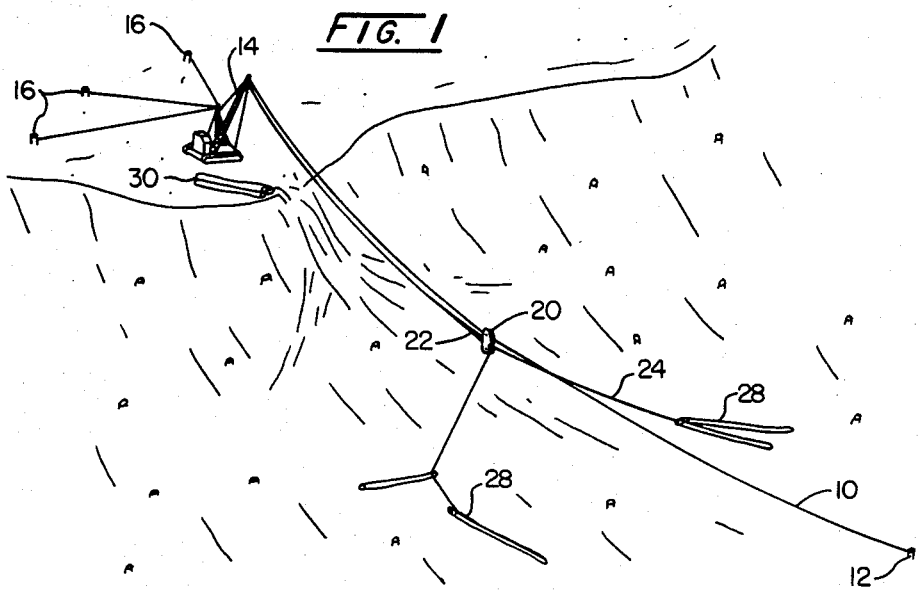
FIG. 1 is a schematic view of a skyline logging system with a carriage according to the present invention.

With reference to the drawings, in FIG. 1 there is illustrated a skyline logging system in which a high line or skyline 10 is connected at its two ends respectively to a ground anchor 12, preferably a stump, and a yarder machine 14, usually a modified crane assembly. The yarder machine 14 is conventionally anchored to the ground at several points 16 in order for the yarder machine 14 to maintain the tension on the high line 10.

A carriage 20 rides along the skyline 10 with load lines 22, 24 passing through the carriage 20 to "turns" of logs 28. In the operation of a skyline logging system, the "turns" of logs may be drawn up into the air to be suspended directly below the carriage 20 or may be dragged along the ground from the place where they were felled to a landing area 30 adjacent the yarder machine 14.

It will be appreciated that the proper operation of a pulley or sheave over a cable is optimized when the direction of the application of force to the cable is parallel to and coincident with a line extending from the center of rotation of the block or pulley through the axis of the cable that is passing over the block. If the force applied to the cable does not coincide with this direction then side forces relative to the block are imparted to the block and in fact the block may slip sideways on the cable, that is, sideways relative to the preferred direction of force application. As a result the carriage or track block may jump off the cable or become entangled in the cable thereby rendering the block inoperable with respect to that cable.

In a carriage of the design known in the prior art having a single load block and a single track block vertically disposed relative to one another, the force appllied to the high line cable by the track block will necessarily be in the preferred direction. However, if the load block is located in such a way that the force on the load cable at its axis is offset from the intersection with the preferred load line so that a line passing through the center of rotation of the load block and through the axis of the load cable does not pass through the axis of the highline cable, then the force on the highline cable will not be in the preferred direction.

Figure 2:
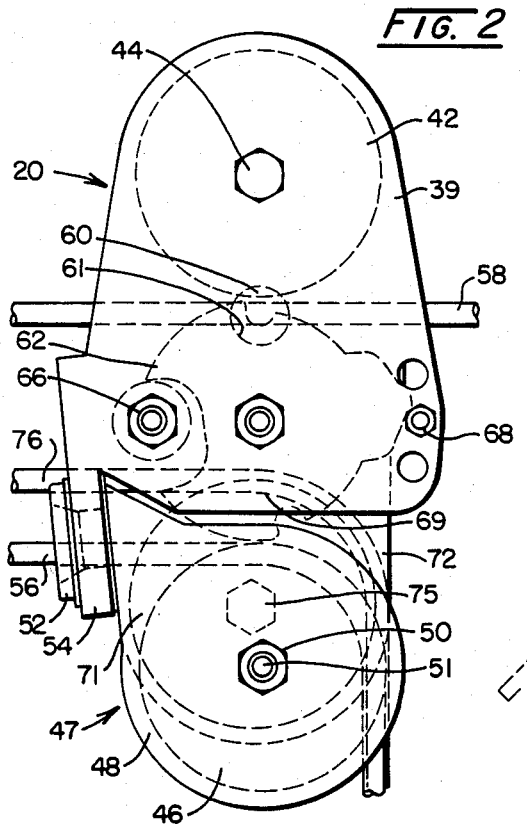
FIG. 2 is an enlarged side elevational view of the carriage of FIG. 1.
Figure 3:
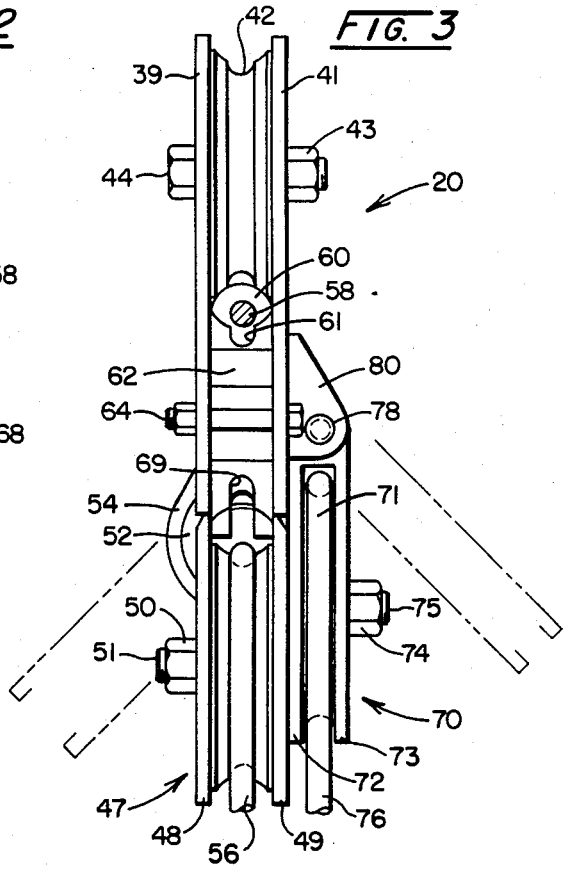
FIG. 3 is a front elevational view of the carriage of FIG. 2.

Illustrated in FIG. 2 is a carriage 20 which is preferrably made of two pieces of flat plate 39, 41, flat plate 41 is spaced apart from and is hidden behind flat plate 39 in FIG. 2 being more clearly shown in FIG. 3. A track block 42 is retained between the plates 39, 41 by a nut 43 and bolt 44 combination which allows track block 42 to freely rotate within the carriage frame formed by plates 39, 41. A first load block 46 is retained between separate plates 48, 49 which are also spaced apart one be hind the other in FIG. 2, and more clearly depicted in FIG. 3. Load block 46 is retained between plates 48, 49 by a nut 50 and bolt 51 combination allowing load block 46 to freely rotate between the plates 48, 49.

The first load block 46 and its frame, formed by plates 48, 49, constitute a load block assembly 47 which is pivotably mounted on carriage frame 20 by male extensions 52 from plates 48, 49 which extend through a collar retainer 54 on carriage frame 20. The combination of male extensions 52 and retainer 54 provides a pivotable connection between the carriage frame 20 and the load block assembly 47. A load cable 56 passes through the circular opening formed by the male extensions 52 and collar retainer 54 and subsequently over load block 46. Additionally, track cable 58 passes through carriage frame 20 and under track block 42, passing through a ball stop 60 which is fixedly mounted on the track cable 58 and acts as a stop against which the travel of the carriage may be terminated.

When ball stop 60 is encountered by the carriage 20 along track cable 58, it engages a concave detent 61 in clamping mechanism 62, thereby rotating clamping mechanism 62 about a pivotable connect 64, which is preferably a nut and bolt combination which retains clamping mechanism 62 between the plates of carriage frame 20, locking the carriage to the track line 58 and releasing load line 56. Additionally acting to retain the plates 39, 41 in properly spaced apart relationship are nut 66 and bolt 68 connecting means which have been located to prevent interference with the operation of clamping mechanism 62, preferably a Christy type logging highline stopping mechanism. Clamp mechanism 62 also has a concave detent 69 on its opposite side from detent 61 which received ball stop 60. Detent 69 is positioned to receive a stop ball, not shown, located on load line 56 which will rotate clamping mechanism 62 to lock load line 56 and release the track line 58.

A second load block 70 is retained in a second load block frame 73 by a nut 74 and bolt 75 connecting means such that second load block 70 freely rotates within second load block frame 72. A second load cable 76 passes over second load block 70, however, second load line 76 does not operate the Christy type clamping mechanism 62.

A front elevational view of a carriage 30 is illustrated in FIG. 3, more clearly showing the positioning of the first load block 46 relative to the track block 42. This positioning, the load block located below the track block, assures that the force of the track block 42 will be directly onto and through the axis of track cable 58. The pivotable mounting of load block assembly 47 on the carriage assembly is of more significance in conjunction with the second load block assembly 70 as described below. In this fashion the proper and optimal utilization of the sheaves in the load block assemblies and the track block assembly is substantially achieved, the optimum situation having been previously described.

The first load block assembly 47 is pivotably mounted relative to carriage frame 20 with the axis of rotation of the pivot being on the axis of load cable 56. The purpose of locating the axis of rotation of the pivot at this location is so that the Christy type logging highline stopping mechanism may be utilized in locking the first load line.

Additionally shown in FIG. 3 in more detail is the pivotable connection 78 by which second load block assembly 70 is pivotably mounted to carriage 20, the pivot joint 78 being through a gusset plate 80 which is fixedly attached to carriage frame 20.

The second load block assembly 70 is similar to assembly 47 described above, a sheave or load block 71 being freely rotatable retained in a frame formed of spaced apart flat plates 72, 73 by a nut 74 and bolt 75 combination. A second load cable 76 passes through second load block assembly 70, the cable terminating on the one end at the yarder machine 14 and at the other in a "turn" of timber.

When two load cables 56, 76 are each bearing the weight of "turns" of timber at different angles from each other the two load blocks 46, 70 may be pivoted such that there is an angle between them. In this case, which easily occurs when "turns" of timber are dragged from different locations at the same time, the entire carriage assembly 20 will inherently self adjust its position so that the components of force will resolve themselves in a single component of force along the preferred line passing through the center of the rotation of track block 42 through cable 58. No side forces will be present on the carriage because of the relative swiveling of the first and second load block 46 and 70 respectively about their respective pivot points 54 and 78. In any event, any minor side forces on track cable 58 will be minimized by the configuration above described.

It will be appreciated that a plurality of load blocks such as the second load block assembly 70 may be disposed upon such a carriage frame, and such auxiliary load blocks may each bear a load cable capable of handling a "turn" of timber.

It will be apparent from the above description that this invention provides an improved carriage for use in a high line logging system in which the carriage can accommodate at least two load lines for bearing "turns" of timber to the landing area near the yarder machine in which each of the load lines passes through a load block assembly that is pivotably attached to the carriage.

Having thus described this invention, what is claimed is:

1. A skyline logging system including a ground anchor, a crane having a vertically extending boom, a high line connected in tension to the anchor and the upper end of the boom, a carriage mounted to move along said high line, a plurality of load blocks pivotally mounted on said carrige below said high line and a separate load line means extending from each load block for supporting separate loads, the carriage including a pair of spaced apart plates, means for securing the plates in relative position with a circular track block and a locking means mounted therebetween, said track block being free to rotate about its axis while engaging the high line and not engaging the locking means, means secured to said high line for (1) preventing movement of said carriage away from said crane along said high line, (2) moving the locking means to locking position with respect to the track block and (3) simultaneously unlocking a first of said load blocks;

means secured to the load line extending from said first load block for (1) moving the locking means to locking position with respect to said load line and (2) simultaneously unlocking the track block to rotate, each of said load blocks being circular and secured between a pair of plates, means for holding the pairs of plates associated with said load blocks in relatively stationary position with respect to each other while allowing each load block to rotate about the axis of its circular shape, each pair of plates associated with each load block being pivotally secured to said carriage with the axis of rotation of said pivotal security being substantially parallel with the adjacent high line and substantially perpendicular to the axis of the associated circular shape.

2. The system of claim 1 wherein the axes of the pivotal securities are substantially parallel to each other.

3. The system of claim 2 wherein the pair of plates associated with said first load block are pivoted from said carriage by a pair of male extensions projecting toward said crane, said extensions being journaled in an annular collar which is clamped to said carriage.

4. The system of claim 1 wherein the pair of plates associated with said first load block are pivoted from said carriage by a pair of male extensions projecting toward said crane, said extensions being journaled in an annular collar which is clamped to said carriage.

* * * * *